US005305582A

United States Patent [19]

Abbott

[11] Patent Number: 5,305,582

[45] Date of Patent: Apr. 26, 1994

[54] METHOD FOR TWO-STAGE PRESSURIZATION OF DISPENSING CONTAINER

[75] Inventor: Joe L. Abbott, Cumberland, R.I.

[73] Assignee: Enviro Pak International, Lincoln, R.I.

[21] Appl. No.: 20,174

[22] Filed: Feb. 22, 1993

Related U.S. Application Data

[63] Continuation of Ser. No. 593,854, Oct. 5, 1990, abandoned.

[51] Int. Cl.[5] ..... B65B 31/00

[52] U.S. Cl. ..... 53/470; 53/473; 53/474

[58] Field of Search ..... 53/133.2, 281, 284.5, 53/470, 473, 474, 485; 141/3, 20

[56] References Cited

U.S. PATENT DOCUMENTS

| | | | |
|---|---|---|---|
| 2,815,152 | 12/1957 | Mills . | |
| 3,235,137 | 2/1966 | Bonduris . | |
| 3,240,394 | 3/1966 | Modderno . | |
| 3,291,348 | 12/1966 | Chibret et al. | 53/470 X |
| 3,430,819 | 3/1969 | Moonan | 53/470 X |
| 3,496,969 | 2/1970 | Bruce et al. | 141/20 |
| 3,513,886 | 5/1970 | Easter et al. | 141/20 |
| 3,578,210 | 5/1971 | Pitroiffy-Szabo . | |
| 3,718,236 | 2/1973 | Reyner et al. . | |
| 3,977,151 | 8/1976 | Reever et al. | 53/470 X |
| 4,000,836 | 1/1977 | Williams et al. . | |
| 4,117,951 | 10/1978 | Winckler . | |
| 4,373,341 | 2/1983 | Mahaffy et al. . | |
| 4,427,039 | 1/1984 | Brooks et al. | 141/20 |
| 4,478,044 | 10/1984 | Magid . | |
| 4,679,706 | 7/1987 | Magid et al. . | |
| 4,750,314 | 6/1988 | Mietz et al. | 53/470 |
| 4,896,794 | 1/1990 | Banks et al. . | |
| 4,909,420 | 3/1990 | Reyner . | |

*Primary Examiner*—John Sipos
*Assistant Examiner*—Linda B. Johnson
*Attorney, Agent, or Firm*—Weingarten, Schurgin, Gagnebin & Hayes

[57] ABSTRACT

A method is provided for the two-stage pressurizing of a product in which a propellant gas may be immediately generated for use as a high-pressure propellant after the sealing of the container. A first reactant and the flowable or sprayable product which is desired to be dispensed is placed into the container until the container is substantially full. The container is then sealed. A second reactant, which may be dissolved in a further amount of product, is introduced in liquid form into the sealed container through a dispensing valve, another valve, or a sealable plug. The first and second reactants react to generate the propellant, which is then contained or dissolved with the product in the container until needed. As product is expelled, the propellant evolves out of the product to exert expulsive pressure. Thus, the invention involves the process of charging during the filling of product and allows the product to be dispensed promptly and continuously thereafter. The charging method of the invention requires minimal fill time, and does not rely on numerous materials, equipment, and processing steps, and yet the method provides a relatively high dispensing pressure and substantially complete expulsion of the product.

23 Claims, 1 Drawing Sheet

METHOD FOR TWO-STAGE PRESSURIZATION OF DISPENSING CONTAINER

This application is a continuation of application Ser. No. 07/593,854, filed Oct. 5, 1990 now abandoned.

FIELD OF INVENTION

This invention relates to product dispensing containers, and more particularly to a method for pressurizing in two stages the contents of containers with dispensible product.

BACKGROUND OF THE INVENTION

Manufacturers of aerosol cans and other pressurized dispensing containers are continually compelled to seek ways to achieve conflicting goals. One of those goals, for example, is the capability of obtaining high dispensing pressure in a can. The attainment of this goal, however, is frequently hindered by the fact that the means for achieving such pressure occupies some of the volume that would otherwise be reserved for the product. An example of this is the use of a piston which exerts upward force against the product in the can by means of compressed air beneath the piston. A simpler example of the dilemma, of course, is where compressed gas alone is used in the container after it has been sealed; the volume occupied by the compressed gas cannot otherwise be used for storing dispensible product.

Another goal of the art is to provide a pressurized container that achieves substantially complete expulsion of the product. The use of compressed gas for this purpose, however, is fraught with delays and additional expense incurred during manufacturing and packaging. Where high pressure is desired, sufficient space must be reserved within the product container for the propellant gas at an intended pressure. The product must usually be placed within an unsealed container, which is then sealed, and subsequently a propellant must be introduced, under pressure, into the can through the valve or plug. The gas charging stage requires considerable time. Where the compressed gas is dissolved into the product, the manufacture must suffer delay while the gas dissolves into the flowable or sprayable material. While carbon dioxide affords high pressure when used as a compressed gas propellant, the process of dissolving the carbon dioxide into the product is commercially undesirable because it takes several hours to accomplish.

Manufacturers have turned to methods employing carbon dioxide, in part, because of an increased awareness of the deleterious effect of chlorofluorocarbons on the stratospheric ozone layer and because of the attractiveness of placing the pressure generating system within the container. As disclosed in U.S. Pat. No. 3,718,236, a system is used for generating carbon dioxide gas by combining sodium bicarbonate and citric acid within a sealed bag-like structure that is free-floating within the dispensing container. In one disclosed embodiment, the inflatable bag includes a number of sealed compartments containing solid tablets of sodium bicarbonate. The sealed compartments are sequentially ruptured as product is expelled, permitting the sodium bicarbonate to combine with a mixture of citric acid and water also located within the inflatable bag, and gas pressure within the bag is thereby generated to expel the flowable product.

U.S. Pat. Nos. 4,373,341; 4,478,044; and 4,909,420 essentially follow the concept disclosed in U.S. Pat. No. 3,718,236 but introduce changes in the manner by which the inflatable bag and rupturable compartments are constructed or fabricated. The bag-like structures disclosed in those patents are relatively complex. They also require additional expense, materials, and manufacturing steps. Further, these structures involve the citric acid and sodium bicarbonate reaction only after the dispensing can is sealed, and they require that the reaction be initiated and that it occur throughout the dispensing life of the container. These structures are intended to maintain constant pressure, but do not provide an inexpensive and quick manner of charging the container with immediately active carbon dioxide which is stored for use upon demand within the contained product.

In view of the foregoing limitations and objectives, a method is needed for pressurizing a dispensing container in an economical, convenient, and expeditious manner.

SUMMARY OF THE INVENTION

In surmounting the aforementioned difficulties, the present invention provides a method in which relatively high dispensing pressure and substantially complete product expulsion are achieved by generating the propellant within the container and storing it within the flowable or sprayable product for use upon demand. The invention achieves these purposes without incurring substantial delay of fill-time, without introducing multiple process steps, and without employing expensive materials and process equipment as typically required by prior gas propellant methods.

The propellant is generated within the dispenser container in two separate, relatively quick filling stages in which a first reactant and then a second reactant are placed into the can. As an example, sodium bicarbonate and citric acid may be used as first and second reactants to generate carbon dioxide. Sodium bicarbonate and the flowable or sprayable product are placed within the can, which is then sealed. Citric acid, which may be premixed in a further amount of the flowable or sprayable product, is then introduced in liquid form into the dispensing container through the dispensing valve or other valve or sealable plug. The citric acid and sodium bicarbonate immediately react in the sealed container to produce carbon dioxide which is contained or dissolved within the product until needed. As product is dispensed, the carbon dioxide evolves out of the product to pressurize the container. It is advisable to leave a small space within the container unfilled by liquid to permit an initial reserve of carbon dioxide to form.

The present invention avoids the use of pistons, chambered bags, or other mechanical expulsion devices which are complex and otherwise occupy significant volume within the dispenser container. The invention also avoids the uncertainty and delay in the reliable generation of propellant gas suffered by the prior art techniques which require in situ rupturing of a bag or the like to produce the gas reaction. Moreover, the invention does not entail numerous process steps or materials. The present invention additionally avoids the delay involved when compressed gas is introduced into the container through the dispensing valve or through a plug after the container is sealed, as heretofore performed in the art.

The present invention may be used for a number of flowable or sprayable products, such as hand lotions, dentifrices, soap, hair spray, water-based paints, and other water-compatible products, where carbon dioxide or other gas is used as propellant. The invention is ideally suited for use in expelling alcohol-based products, such as de-icers, because carbon dioxide readily dissolves into alcohol containing sufficient amounts of water to provide the reaction.

DESCRIPTION OF THE DRAWINGS

These and other features of the present invention may be more fully understood from the following detailed description taken together with the solely exemplary drawing wherein.

DETAILED DESCRIPTION OF THE INVENTION

Figure 1B:
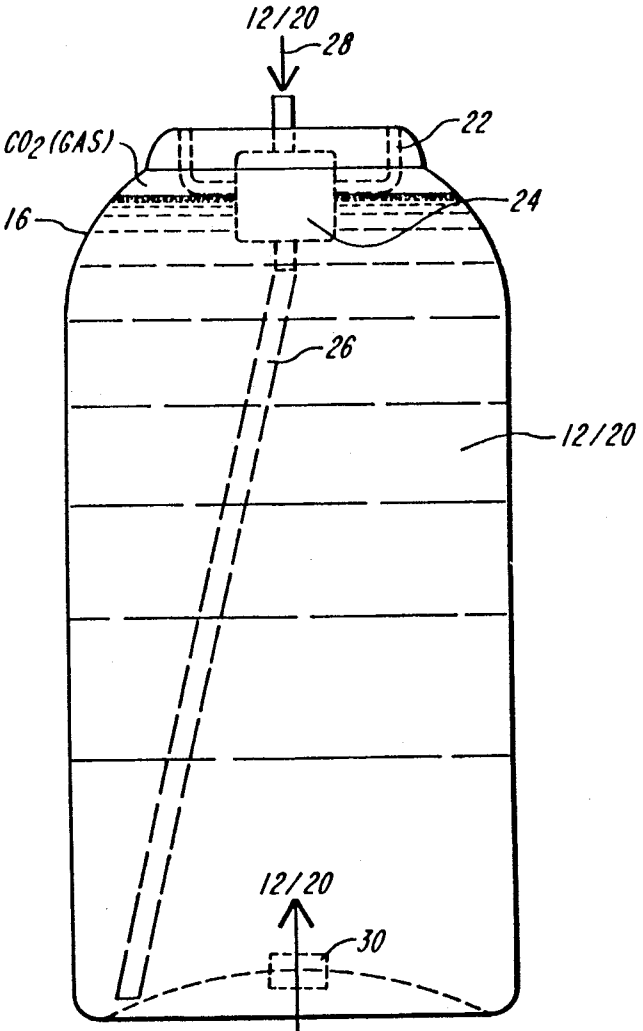
FIGS. 1*a* and 1*b* are diagrams illustrating the two steps of introducing a first reactant and a second reactant sequentially into the dispensing container to be pressurized.
Figure 1A:
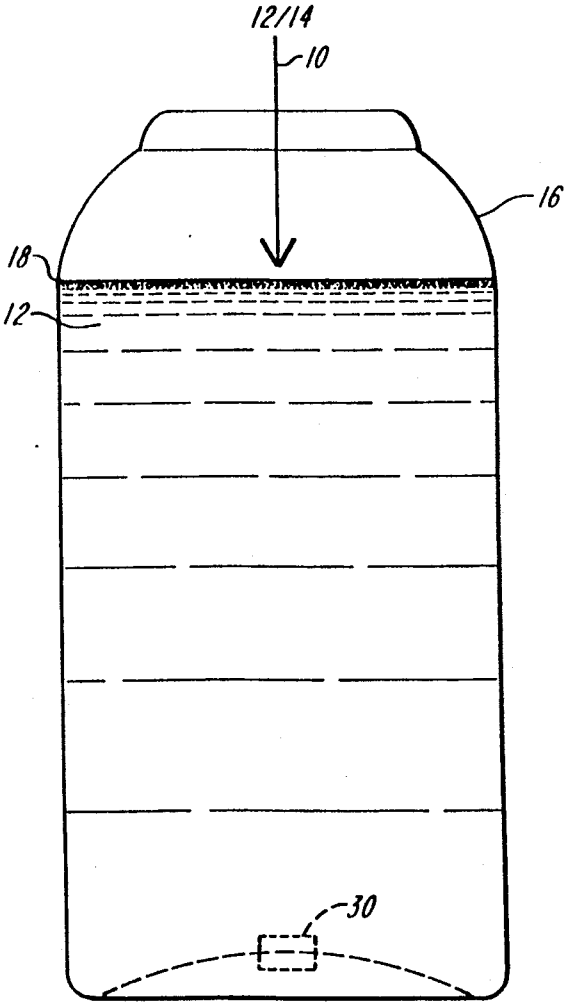

As designated generally by an arrow at 10 in FIG. 1*a*, the flowable or sprayable product 12 desired to be dispensed and a first reactant 14 such as sodium bicarbonate are placed into the container 16. The product and first reactant may be added as a mixed liquid, or added sequentially, to the container 16. The product 12 and first reactant 14 mixture should fill a substantial volume of the container 16, as indicated generally at 18. Subsequently, as shown in FIG. 1*b*, the container 16 is sealed by attaching onto the container 16 a mounting member 22, such as a cup or other container sealable portion. Typically, the mounting cup 22 contains a valve assembly 24 and dip tube 26. After the container 16 is sealed, a second reactant 20 such as citric acid, dissolved in a further amount of the product 12 or other liquid, is introduced into the container 16 through the dispensing valve assembly 24, as generally indicated by an arrow at 28. The liquid mixture of the remaining product and citric acid 12/20 may also be introduced into the container 16 through another valve (not shown) or a sealable plug 30, as indicated generally by an arrow at 32. The first reactant 14 and second reactant 20, which are thus introduced into the container 16 in two separate stages, before and after the sealing of the container 16, generate gas (such as carbon dioxide) for pressurizing the contents of the container 16.

The amount of flowable product 12 and first reactant 14 placed into the container 16 prior to sealing the container 16 should be as substantial as possible, depending upon the concentration of first reactant 14 required and upon the amount of second reactant 20 required to be introduced during the second stage (FIG. 1*b*) of charging. It is preferable to fill the container 16 as much as possible in the initial stage 18, as shown in FIG. 1*a*, to minimize the charging time required for injecting the product 12 and second reactant 20 into the sealed dispenser 16, as generally shown in FIG. 1*b*. The respective amounts of first reactant 14 and second reactant 20 required will also vary according to the amount of pressure desired, taken together with the size of the dispensing valve 24 and the expulsion characteristics of the product 12 to be dispensed.

Where the first reactant 14 is sodium bicarbonate and the second reactant 20 is citric acid, the present invention is ideally suited for dispensing alcohol or alcohol-based products, such as de-icers and hair preparations, in view of the ability of the generated carbon dioxide to dissolve in alcohol. The generated carbon dioxide will evolve out of the container contents as product is expelled, maintaining a relatively high propellant pressure within the container 16. Use of the invention for carbon dioxide-miscible products affords a relatively high dispensing pressure and high degree of product expulsion.

The sodium bicarbonate 14 and citric acid 20 may be interchanged as first and second reactants, but use of citric acid as the second reactant may be preferable where the length of time required for the second charging stage must be minimal, because citric acid is more easily dissolvable than sodium bicarbonate and thus requires smaller volumes of liquid in which it is dissolved. The sodium bicarbonate—citric acid reaction requires the presence of water for the reaction to occur. This is usually satisfied where a water-based product is dispensed. Otherwise, it is advisable to ensure that water is present.

While a preferred embodiment of the invention has been shown and described herein, it is to be understood by those skilled in the art that modifications may be made therein without departing from the scope and spirit of the invention.

What is claimed is:

1. A method for two-stage pressurization of a dispensing container, comprising the steps of:

placing a predetermined amount of product and a first reactant into said dispensing container;

sealing said dispensing container under atmospheric conditions to provide an ambient pressure within said container; and introducing into said sealed container, under external control, a predetermined amount of a second reactant in solution to cause said first reactant and said second reactant to react to generate a gas for pressurizing the contents of said container at a desired pressure to dispense said product.

2. The method of claim 1 wherein the step of sealing said dispensing container includes sealing said container with a member having a valve assembly for permitting flowable or sprayable product to be dispensed from said container.

3. The method of claim 2 wherein the member includes a dip tube for channeling said flowable or sprayable product within the container to the valve assembly on the member.

4. The method of claim 1 wherein the step of introducing said second reactant into the dispensing container further comprises introducing said second reactant through a valve in the container.

5. The method of claim 1 wherein the step of introducing said second reactant into the dispensing container further comprises introducing said second reactant through a plug in the container.

6. The method of claim 1 wherein the step of introducing said second reactant into the dispensing container further comprises mixing said second reactant with liquid prior to introducing it into the container.

7. The method of claim 1 wherein the step of introducing said second reactant into the dispensing container further comprises mixing said second reactant with a further amount of product prior to introducing it into the container.

8. A method for two-stage pressurization of a dispensing container, comprising the steps of:

placing product and sodium bicarbonate into said dispensing container until said container is substantially full;

sealing said dispensing container under atmospheric conditions to provide an ambient pressure within said container; and controllably injecting under an externally applied force into said sealed container a predetermined amount of citric acid in liquid form to cause said sodium bicarbonate and said citric acid to react to produce carbon dioxide at a desired pressure for pressurizing said dispensing container.

9. The method of claim 8 wherein the step of sealing said dispensing container includes sealing said container with a member having a valve assembly for permitting the product to be dispensed from said container, and having a dip tube for channeling product within the container to the valve assembly on the member.

10. The method of claim 8 wherein the step of introducing citric acid into the dispensing container further comprises introducing said citric acid into the container through a valve in the container.

11. The method of claim 8 wherein the step of introducing said citric acid into the dispensing container further comprises introducing said citric acid into the container through a plug in the container.

12. The method of claim 8 wherein the step of introducing citric acid into the dispensing container further comprises mixing the citric acid with a liquid prior to introducing it into the container.

13. The method of claim 8 wherein the step of introducing citric acid into the dispensing container further comprises mixing the citric acid with a further amount of the product prior to introducing it into the container.

14. A method for two-stage pressurization of a dispensing container, comprising the steps of:

placing product and citric acid into a compartment of said dispensing container until said container is substantially full;

sealing said dispensing container under atmospheric conditions to provide an ambient pressure within said container; and controllably introducing under an externally applied force into said compartment of said sealed container a predetermined amount of sodium bicarbonate in liquid form to cause said citric acid and said sodium bicarbonate to react to produce carbon dioxide at a desired pressure for pressurizing said dispensing container.

15. The method of claim 14 wherein the step of sealing said dispensing container includes sealing said container with a member having a valve assembly for permitting the product to be dispensed from said container, and having a dip tube for channeling product within the container to the valve assembly on the member.

16. The method of claim 14 wherein the step of introducing sodium bicarbonate into the dispensing container further comprises introducing said sodium bicarbonate into the container through a valve in the container.

17. The method of claim 14 wherein the step of introducing sodium bicarbonate into the dispensing container further comprises introducing said sodium bicarbonate into the container through a plug in the container.

18. The method of claim 14 wherein the step of introducing sodium bicarbonate into the dispensing container further comprises mixing the sodium bicarbonate with a liquid prior to introducing it into the container.

19. The method of claim 14 wherein the step of introducing sodium bicarbonate into the dispensing container further comprises mixing the sodium bicarbonate with a further amount of the product prior to introducing it into the container.

20. The method of claim 1 wherein the product and a first reactant are placed into the container simultaneously as an admixture.

21. The method of claim 1 wherein the first reactant is in liquid form.

22. The method of claim 1 wherein the predetermined amount of product and first reactant are placed in the container until the container is at least half full.

23. The method of claim 1 wherein the predetermined amount of product and first reactant are placed in the container until the container is substantially full.

* * * * *